United States Patent [19]

Cosgrove et al.

[11] 4,079,692

[45] Mar. 21, 1978

[54] COATING APPLICATOR

[75] Inventors: Martin Charles Cosgrove, Harwinton; Robert John Cotter, Meriden, both of Conn.

[73] Assignee: Loctite Corporation, Newington, Conn.

[21] Appl. No.: 646,801

[22] Filed: Jan. 5, 1976

[51] Int. Cl.[2] ..... B05C 3/09

[52] U.S. Cl. ..... 118/3; 118/6

[58] Field of Search ..... 118/1–3, 118/410, 411, 405, 7, 8, 408, 404; 427/430, 435–438

[56] References Cited

U.S. PATENT DOCUMENTS

| | | | |
|---|---|---|---|
| 2,324,455 | 7/1943 | Keim et al. | 118/408 X |
| 2,412,954 | 12/1946 | Zdancewicz | 118/408 |
| 2,426,969 | 9/1947 | Hallowell, Jr. | 118/408 |
| 2,974,367 | 3/1961 | Doering et al. | 156/423 X |
| 3,104,986 | 9/1963 | Goman et al. | 118/2 |
| 3,266,459 | 8/1966 | Anthony | 118/1 |
| 3,682,131 | 8/1972 | Algeri et al. | 118/2 |
| 3,817,210 | 6/1974 | Greever | 118/408 |
| 3,889,628 | 6/1975 | Usab | 118/408 X |

*Primary Examiner*—Morris Kaplan

*Attorney, Agent, or Firm*—Watson, Cole, Grindle & Watson

[57] ABSTRACT

A coating applicator for applying a layer of coating material around the circumference of a portion of an elongated shaft, such as a bolt. The applicator includes a chamber which is filled with coating material and has an opening for receiving the elongated member. The opening in the chamber has a cross-sectional dimension just slightly larger than the elongated member. A cover arranged within the chamber in sealing contact with the opening prevents leakage of coating material. This cover is retractable upon insertion of the elongated member into the chamber. Coating material then totally surrounds and coats the entire circumference of a limited longitudinal portion of the elongated member. The coated elongated member is subsequently removed from the chamber. As the elongated member is removed, the inner walls of the chamber which define the opening serve to remove excess coating material from the member and to smooth the layer of coating material.

21 Claims, 16 Drawing Figures

COATING APPLICATOR

BACKGROUND OF THE INVENTION

The present invention relates to a coating applicator for applying a layer of coating material to a portion of an elongated shaft.

Various different coating apparatuses for coating elongated members, such as pipes and bolts, have been developed in the prior art. One type of system includes a chamber which is passed along an elongated member while coating material is applied through grooves within the chamber for coating the elongated member. Such systems are illustrated in U.S. Pat. Nos. 2,305,005 issued to R. E. Henry; 2,429,915 issued to W. H. Bell; and, 2,892,441 issued to D. E. Stearns.

Another type of system was developed by the assignee of the present application as shown in U.S. Pat. No. 3,795,224 issued to R. E. Batson et al, for coating a plurality of headed bolts. In this system, the bolts are conveyed along an assembly line and pass by a coating block which dispenses coating material into contact with the bolts. This system is designed for mass production coating of elongated members and thus, the members to be coated are rapidly conveyed along the conveying path past the coating station. As the members are so conveyed, they are rotated by the conveyor so that the applied coating material is smoothed on and spread evenly around the circumference of the bolt.

None of the above systems, however, are involved with providing a semi-automatic coating applicator for coating a limited number of elongated members. One previously developed system involved with such an objective, was developed by the assignee of the present application. In this system, a bolt was inserted through an opening in the chamber. After the bolt was inserted, a valve mechanism allowed coating material to flow through a plurality of apertures on the interior surface of the chamber so as to come into contact with the circumference of the bolt. The coated bolt was then removed by hand and another bolt inserted. Thus, the flow of coating material was controlled by a valve member located in the feedline for the coating material so that coating material only flowed when the valve was opened after insertion of the bolt.

SUMMARY OF THE INVENTION

An object of the present invention is to provide a semi-automatic coating applicator for applying a layer of coating material around the circumference of a portion of an elongated member.

Another object of the present invention is to provide a coating applicator which is capable of automatically coating a limited portion of the elongated member in such a manner so as to enable a large number of such members to be coated within a short period of time without having to resort to the mass production technique illustrated in the U.S. Patent to Batson et al, as discussed above.

A further object of the present invention is to provide a coating applicator in which the elongated member to be coated is inserted within a chamber so as to be totally surrounded by coating material, the member is then coated and subsequently the member is automatically ejected from the coating chamber.

These objectives are achieved by the coating applicator provided in accordance with the present invention. This applicator includes a coating chamber which is filled with coating material. The chamber has an opening for receiving the elongated member which is to be coated. The opening has dimensions just slightly larger than the cross-section of the elongated member, so that there can be a close fit of the member within the opening. A retractable cover member is arranged within the chamber for preventing coating material from leaking out of the chamber through the opening. Upon insertion of the elongated member through the opening into the chamber, the cover member is retracted so as to allow coating material to totally surround the entire circumference of a limited longitudinal portion of the elongated member. A coating layer is then applied to the elongated member. After the elongated member has been coated, the member is removed from the chamber. Due to the dimensioning of the inner walls of the chamber, as the coated member is removed, the walls serve to remove excess coating material and to smooth the coating material on the member.

The type of elongated member which is normally coated within such a coating machine is a bolt having a threaded section and a head at one end. It should be noted, however, that any type of elongated shaft can be coated with such a machine. It is not necessary that the shaft either have a threaded section or a head at one end. In fact, it is not even necessary that the shaft have a circular cross-section since the shape of the opening can be varied in dependence upon the type of elongated shaft to be coated.

After the elongated member has been coated, the member is automatically ejected from the chamber. Immediately prior to the ejection of the elongated member, the cover member is returned to its initial position so as to prevent leakage of coating material through the opening.

The cover member utilized in the coating applicator is a sleeve which has inner dimensions sufficiently large so as to surround the perimeter of the opening. The sleeve has a lateral end surface which is shaped so as to correspondingly mate with the inner surface of the chamber around the opening. Thus, when the sleeve is in contact with this inner surface of the chamber, it provides an effective seal and acts as a cover for preventing coating material from leaking through the opening. Furthermore, the sleeve is of a sufficient length so as to prevent coating material from contacting the inserted elongated member until the sleeve has been retracted from its initial position.

The opening and the sleeve both extend in a direction parallel to the longitudinal axis of the chamber. Thus, once the elongated member is inserted through the opening, which would be into a position in the interior of the sleeve, the sleeve is then retracted thereby exposing a portion of the member of the coating material. The sleeve is then returned to its initial position against the inner surface of the chamber in a location surrounding the opening. Subsequently, the elongated member is automatically ejected from the chamber.

While any type of coating material could be applied by the coating applicator of the present invention, the coating material primarily of concern is a slurry containing an adhesive material. The coating material contains a solvent, which is generally water or another solvent which can be easily driven off if the coated layer on the elongated member is to be dried.

Since many elongated members, such as bolts, which are to be coated originally come from the factory with a thin layer of oil or grease on their exterior surfaces, it is necessary to first remove this layer before applying the coating material. This factor is well known in the prior art and in fact is discussed in the U.S. patent to Batson et al. For this reason, the elongated members are first degreased by any type of conventional degreasing equipment so as to provide a clean surface for good adhesion for the coating material. The degreased members are then supplied with a coating layer by the coating applicator of the present invention. Subsequently, a thin layer of oil can again be supplied to the exterior surface of the elongated member and the coated area. The re-application of the oil, however, is an optional process depending upon the particular use to be made of the member and the period of time before such use. The coated and oiled members can then be dried in an oven so as to substantially drive out any solvent present in the applied layer of coating material.

When using the coating applicator, the operator inserts the elongated member into the coating chamber. When the member is pushed firmly against an internal positioner, the automatic cycle is initiated by an air pulse from an actuation valve, which pulse is supplied to the control console. The sleeve member is then retracted by a predetermined distance, thereby exposing the area of the member to be exposed to the coating material. When a metering valve timer has run for a predetermined time, the sleeve is then returned to its extended, initial position and the coated member is automatically ejected from the coating applicator. The coating applicator is then reset for another cycle.

In the preferred embodiment, the control console for this coating applicator is a pneumatic control which utilizes air logic components for maximum reliability and a high degree of accuracy. The control console includes a pressure time device that provides the necessary functions to operate the coating applicator. The coating material is maintained in a reservoir in the control console and is forced through a feedline to the chamber within the coating apparatus. The operator of the system can control the amount of coating material applied by adjusting three controls, the reservoir pressure, the metering valve time cycle and an adjustor for varying the stroke of the sleeve in the coating applicator.

Figure 1:
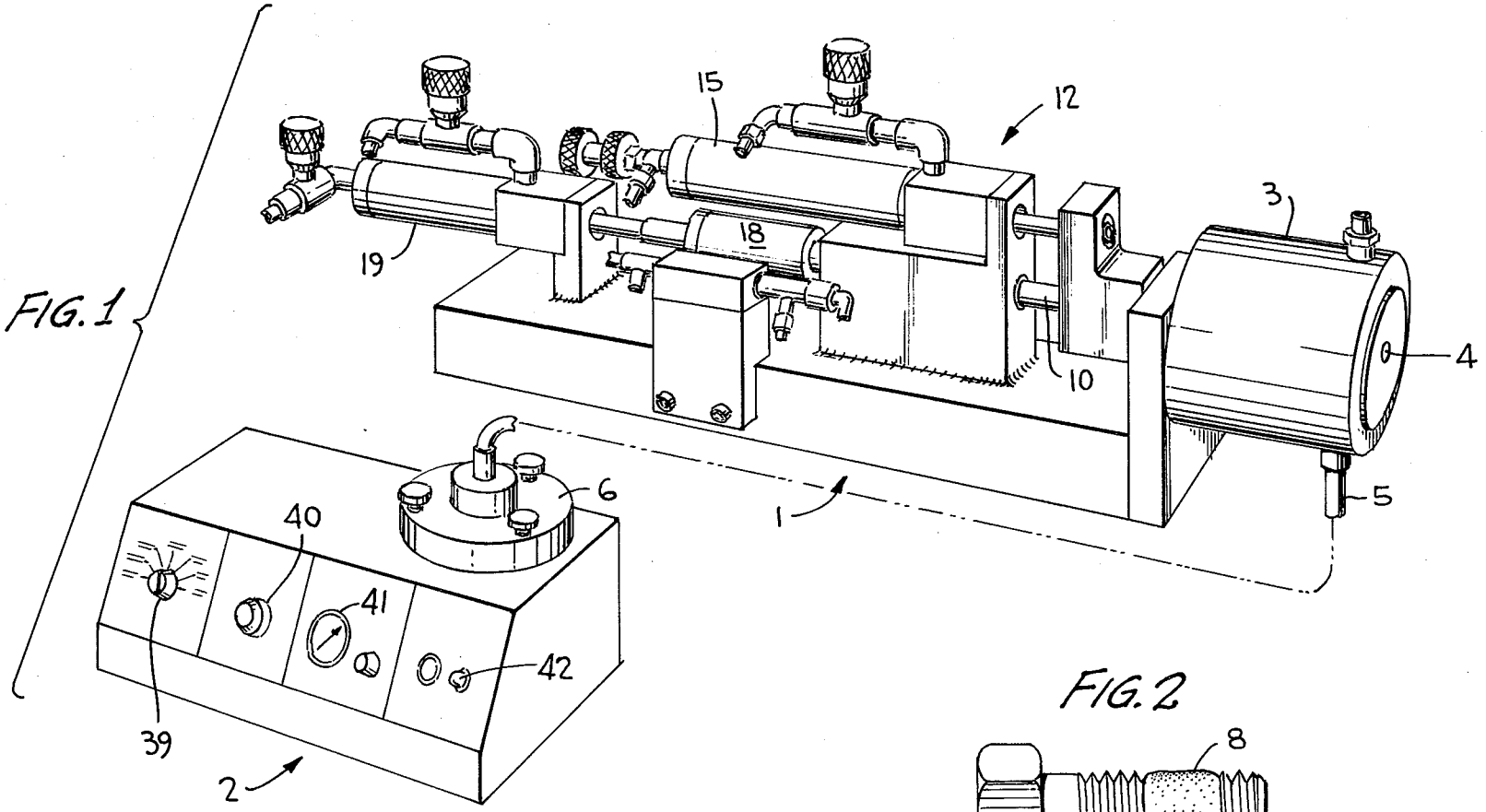
FIG. 1 is a perspective view of the coating applicator including the control mechanism, for coating elongated members in accordance with the present invention.

FIGS. *7a* through *7e* are side elevational sectional views of a portion of the coating applicator illustrated in FIG. 1 during various stages of its operation.

Figure 8:
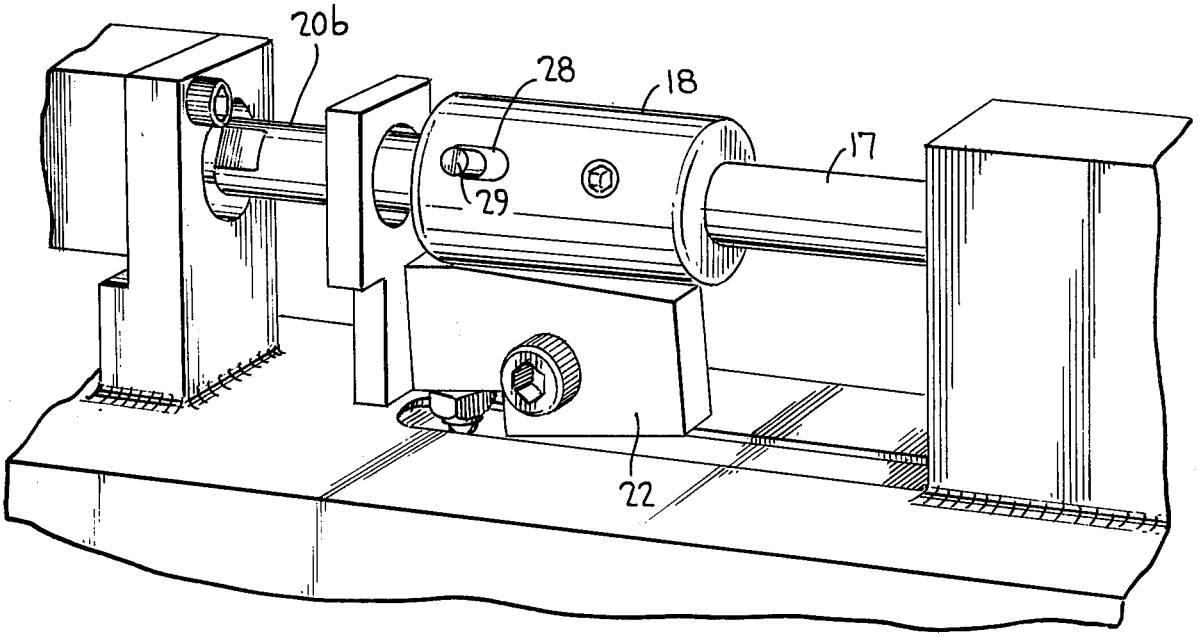

FIG. 8 is a side perspective view of a portion of the coating applicator illustrated in FIG. 1 during one stage of its operation.

Figure 9:
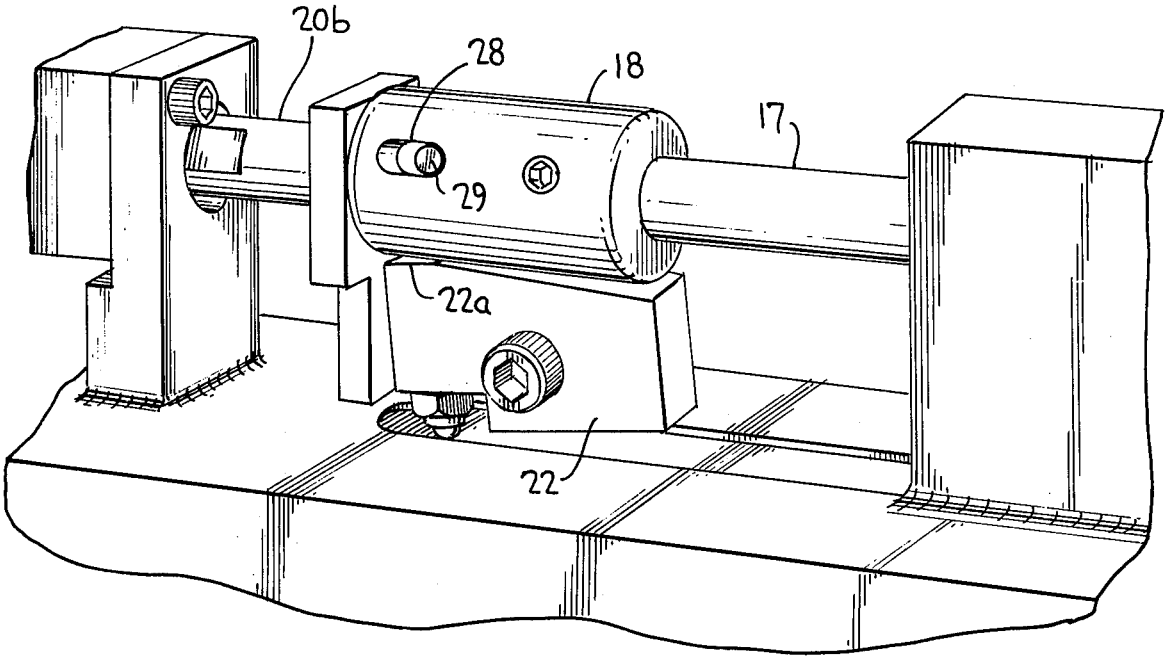

FIG. 9 is the same portion of the coating applicator illustrated in FIG. 8 during another stage of its operation.

Figure 10:
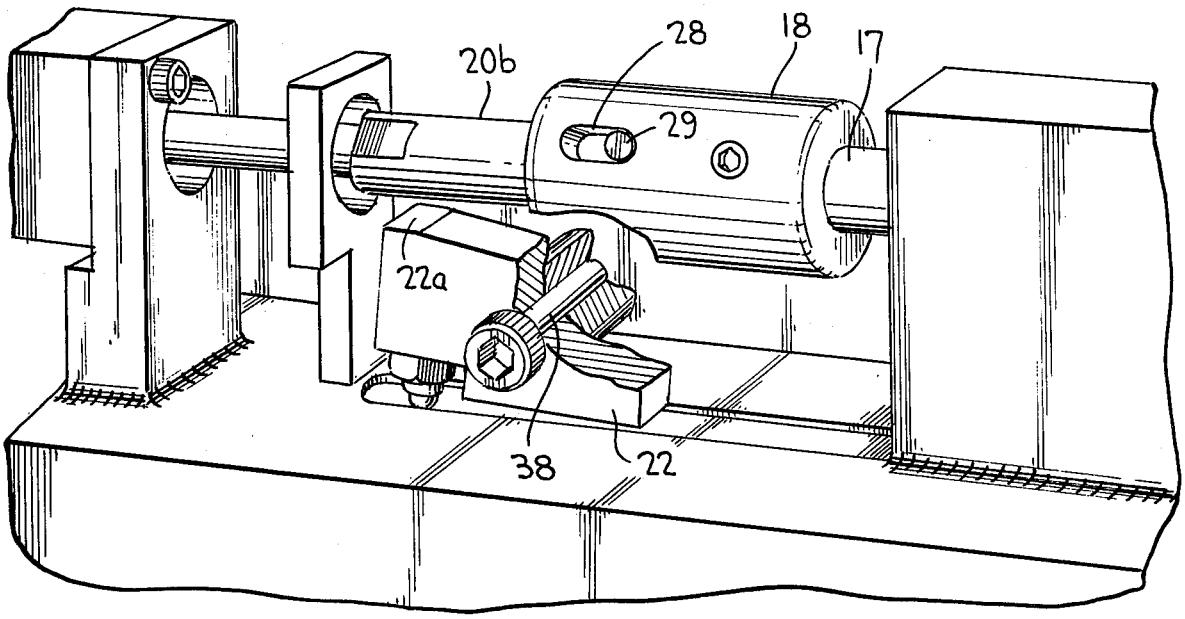

FIG. 10 is another view of the portion of the coating applicator illustrated in FIG. 8 during still another stage of its operation.

Figures 11, 12:
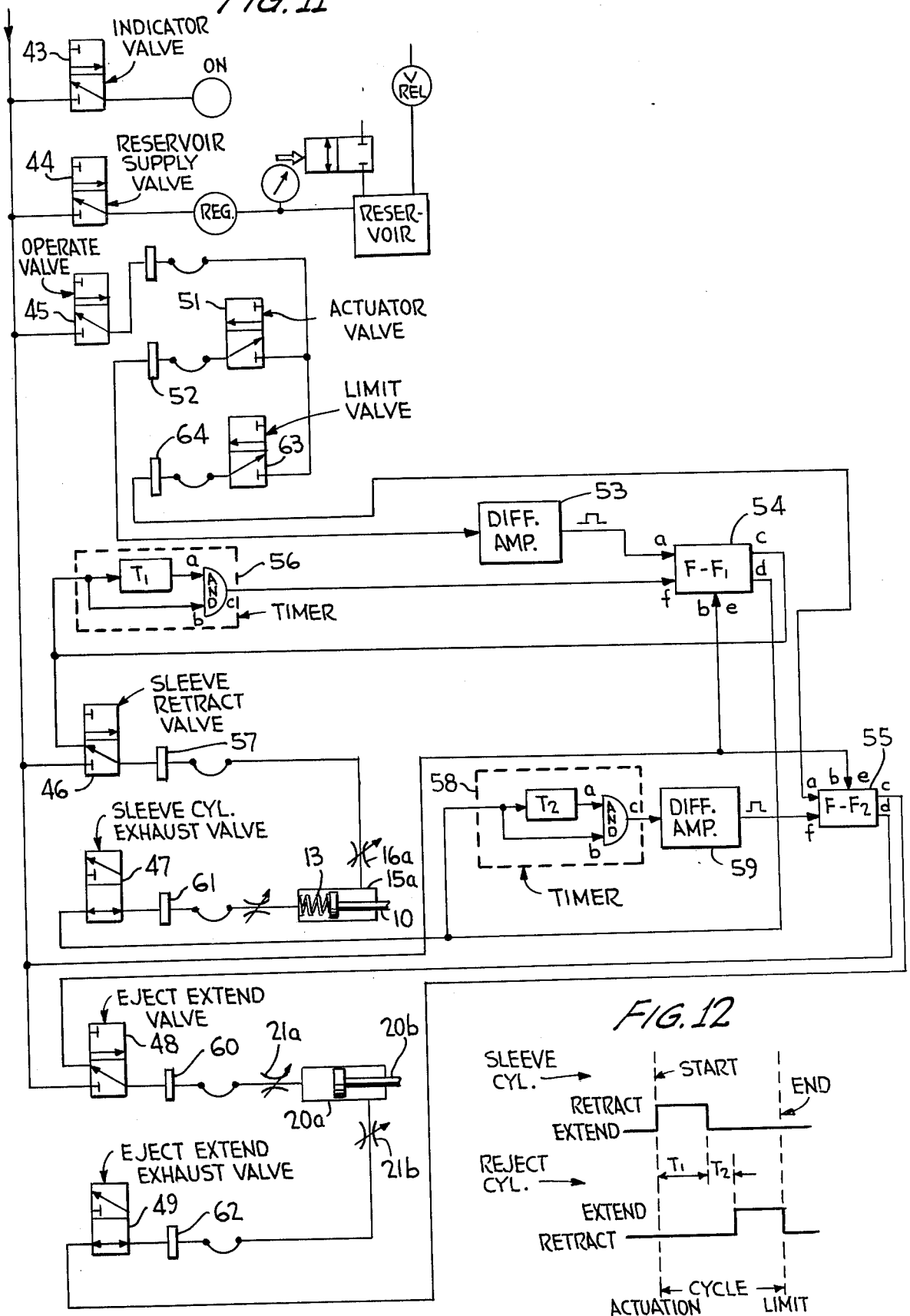

FIG. 11 is a pneumatic circuit diagram illustrating the system for controlling the coating applicator illustrated in FIG. 1.

FIG. 12 is a pulse diagram of the control signals generated by the control system illustrated in FIG. 11.

DESCRIPTION OF THE PREFERRED EMBODIMENTS

The coating applicator of the present invention includes a coating device 1 and a corresponding control device 2, as shown in FIG. 1. Coating device 1 has a chamber 3 which can have its interior hollow section 9 (see FIG. 3) filled with a coating material through feedline 5 from reservoir 6. The longitudinal end wall of the chamber is formed by a plate 32 which is provided with an opening 4, defined by inner wall 33. Opening 4 extends in a direction parallel to the longitudinal axis of chamber 3. It is through this opening 4 that an elongated member, such as bolt 7 (see FIG. 2), is inserted for being coated.

While the coating material is generally utilized as a slurry, it is not necessary that the material be in such form. The only requirement regarding the coating material is that it have a sufficient viscosity so as to not be capable of leaking through opening 4 when it is sealed by a cover member.

Figure 2:
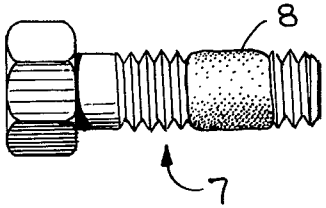
FIG. 2 is a side elevational view of an elongated member which has had a limited longitudinal portion coated by the coating applicator illustrated in FIG. 1.

In FIG. 2, a bolt 7 which has been supplied with a layer of coating material 8 is illustrated. Coating layer 8 has been applied along a limited longitudinal portion of the threaded section of bolt 7. While the coating layer does not extend along the whole length of bolt 7, it does totally surround the circumference of the limited longitudinal portion.

Figure 3:
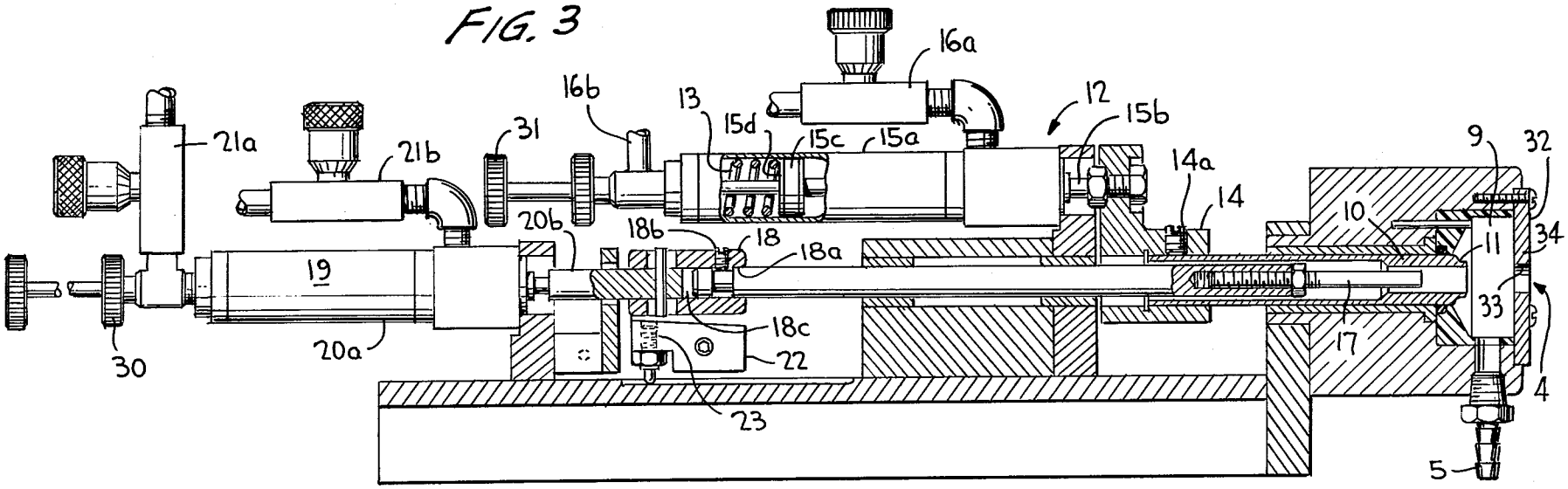
FIG. 3 is a side elevational view of the coating applicator illustrated in FIG. 1 with portions being partially cut away so as to illustrate interior members of the coating applicator.
Figure 4:
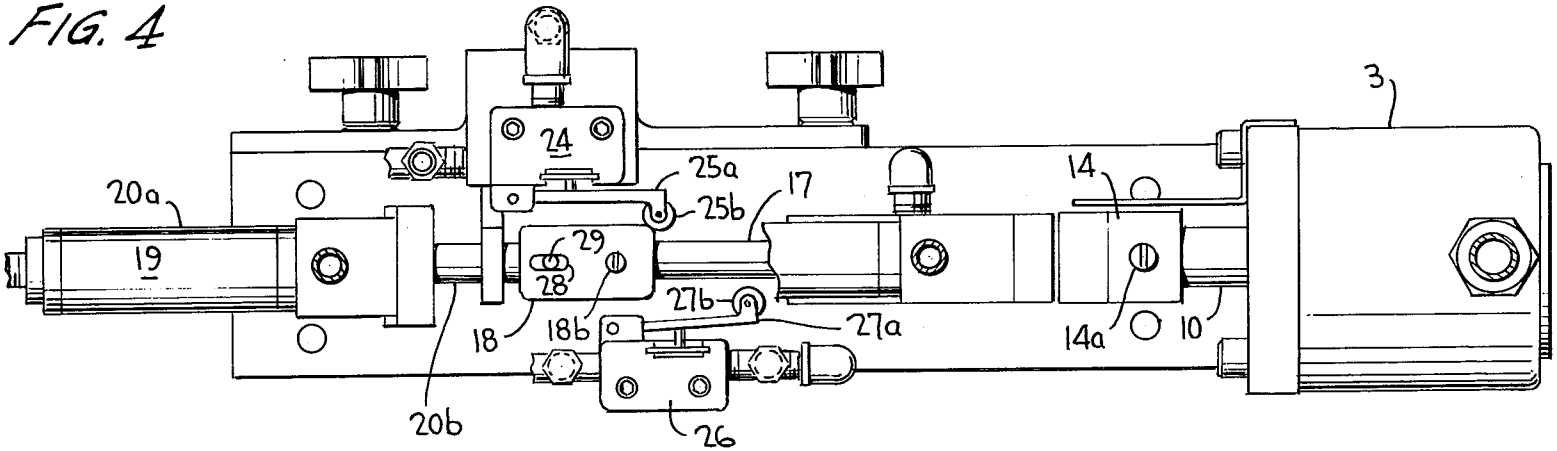
FIG. 4 is a plan view of the coating applicator illustrated in FIG. 1 with portions removed for the sake of clarity.

A cover member for preventing coating material from leaking through opening 4 is formed by sleeve member 10 (see FIGS. 3 and 4). Sleeve member 10, when in its closed position, has its end lateral surface in contact with inner wall 34 of plate 32. In this closed position, the sleeve surrounds the outer perimeter of opening 4 and prevents coating material from leaking through the opening. End surface 11 of sleeve 10 which is to be located adjacent to wall 34 is contoured so as to have a smaller outer dimension than the remaining portion of sleeve 10. This contouring of surface 11 is done in order to provide for beneficial flow forces of the coating material away from the area of opening 4. Thus, as sleeve 10 moves toward opening 4, the coating material easily flows along this contoured section away from opening 4. Due to the relatively small area of contact, an extremely good seal can be maintained between the lateral end surface of sleeve 10 and wall 34.

Mounted within sleeve 10 is a rod 17. Rod 17 has its longitudinal axis extending in a direction parallel to sleeve 10, chamber 3 and opening 4. While one end of rod 17 is mounted so as to move towards opening 4, its other end is coupled to a bushing 18. Bushing 18 has a cylindrical bore; rod 17 enters one end of this bore and is secured therein by a corresponding set screw **18*b***.

Sleeve 10 is mounted within a bore in a block 14 and secured in place by a set screw 14*a*. Block 14 is connected to a pneumatic mechanism 12 for controlling the retraction of sleeve 10 away from opening 4 in plate 32. Sleeve 10 can be biased by a spring 13 so as to be normally held in a closed position in contact with inner wall 34. Upon receipt of an actuating signal, however, retracting mechanism 12 causes sleeve 10 to move in a direction away from wall 34. Retracting mechanism 12 includes a pneumatic cylinder 15*a* and a piston shaft shaft 15*b*. Upon receipt of an appropriate signal, air is supplied through a port 16*a* thereby causing pressure on one face of plate 15*c* and causing piston shaft 15*b* to retract into cylinder 15*a*. Upon retraction of shaft 15*b*, block 14 and correspondingly sleeve 10 are moved in a direction away from opening 4 and wall 34. After a set time period, the air within cylinder 15*a* is allowed to exhaust through port 16*a* and air is supplied through port 16*b* thereby causing pressure on face 15*d* of plate 15*c*. This pressure on face 15*d* along with the force of spring 13 return sleeve 10 to its normally closed position. Spring 13 furthermore acts as a safety mechanism in case the air supply through port 16*b* is accidentally shut off. The spring ensures that the sleeve still will be returned to its closed position. Without this spring, the residual air pressure in the reservoir would push the sleeve away from inner wall 34 thereby allowing the coating material to spill out through opening 4.

The extent to which sleeve 10 is retractable can be adjusted by control knob 31. Rotation of knob 31 will control the extent to which plate 15*c* can be retracted within cylinder 15*a*.

While rod 17 is mounted within one end of bore 18*a*, a pneumatic ejection mechanism 19 is coupled to the other end of bushing 18 by a piston shaft 20*b* entering the opposite end of bore 18*a*. Ejection mechanism 19 includes a pneumatic cylinder 20*a* and piston shaft 20*b*. Shaft 20*b* has an externally extending pin 29 which is mounted so as to be slidable within a slot 28 within bushing 18, as shown in FIG. 4. Rod 17 and the end of piston shaft 20*b* are separated by a free space 18*c* within bushing 18.

Two switch mechanisms 24 and 26 are mounted along the longitudinal axis of the coating applicator so as to be capable of being actuated by movement of bushing 18. Switch mechanism 24 has a lever 25*a* with a corresponding roller 25*b* mounted along one side of bushing 18. Switch mechanism 26 has a lever 27*a* with a corresponding roller 27*b* and is mounted along the opposite side of bushing 18 from switch mechanism 24. While the longitudinal positions of the switch mechanisms are significant, for reasons which will be clear from the description of the operation of the coating applicator as presented further below, the circumferential positions of the switch mechanisms can be varied.

Figure 5:
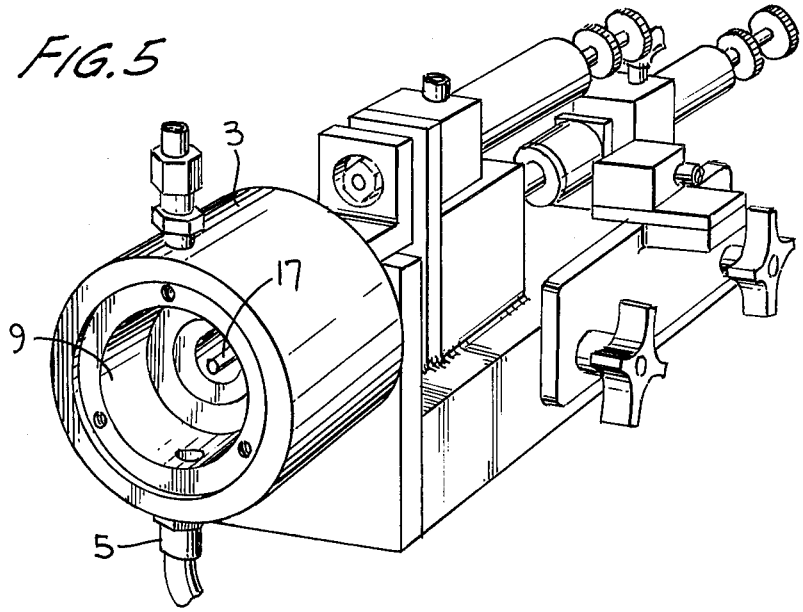
FIG. 5 is a perspective view of a portion of the coating applicator illustrated in FIG. 1, with the cover plate of the coating chamber being removed.
Figure 6:
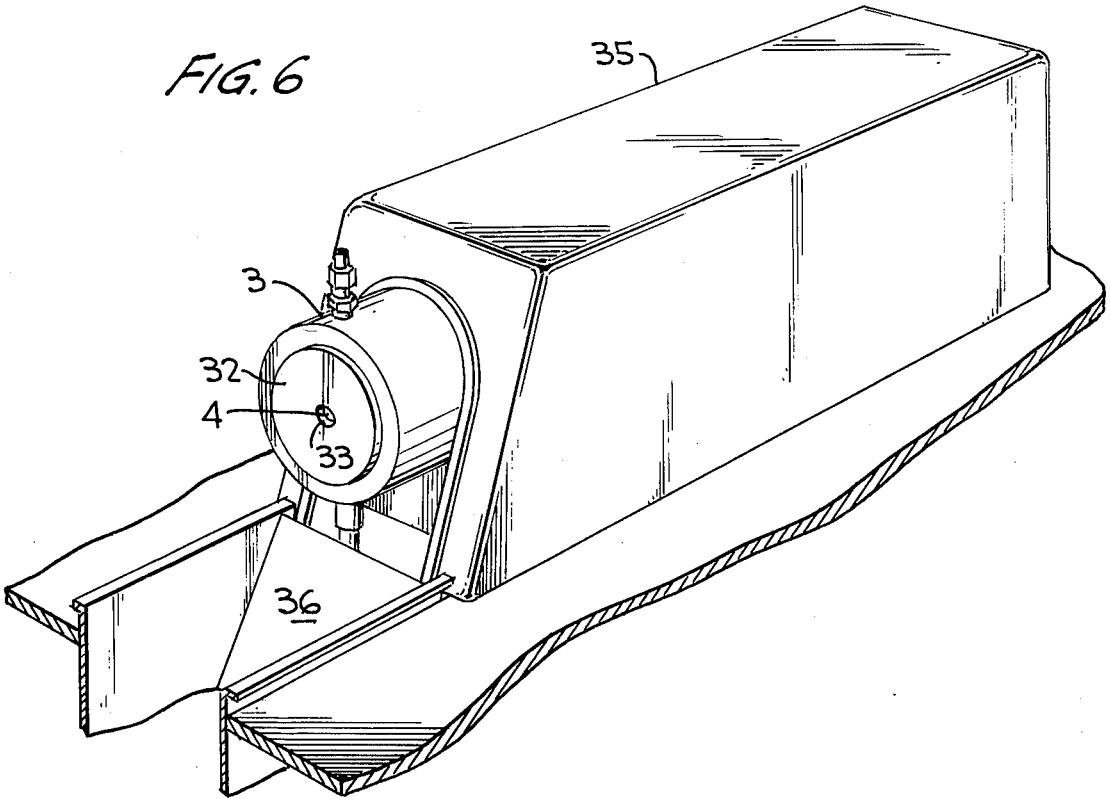
FIG. 6 is a perspective view of the coating applicator illustrated in FIG. 1 mounted on a platform for operation with its covering housing in place.

Interior 9 of chamber 3 is illustrated in FIG. 5, where plate 32 has been removed. As can be seen, rod 17 extends along the longitudinal axis of the chamber into interior space 9 of the chamber. In FIG. 6, the applicator is illustrated with plate 32 having been placed into position and housing cover 35 having been arranged over the working parts of the coating device 1. The elongated members after they are ejected from the applicator drop onto a chute 36 down to a collection pan (not shown) which is located below. If the elongated members are to be re-oiled, a stream of oil can be supplied along chute 36 so that as the members fall the oil is again supplied to the members.

Figure 7A:
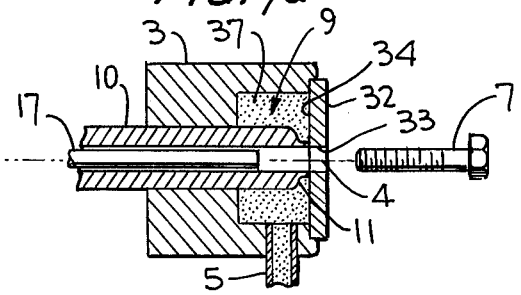

The operation of the coating applicator will now be described with reference to FIGS. 7*a* through 7*e*. During the rest position of the applicator and also during the period when the applicator is being filled with coating material, sleeve 10 is forced against inner wall 34 of cover plate 32. Coating material, such as an adhesive slurry, which is maintained under pressure is transmitted from a reservoir 6 through feedline 5 to the bottom side of chamber 3. Thus, interior space 9 of chamber 3 is filled with a coating material 37, as shown in FIG. 7*a*. When sleeve 10 is in this position, it serves as a cover member for covering the opening 4 and prevents coating material from leaking through the opening.

An elongated member, such as bolt 7, which is to be coated, is inserted through opening 4 in cover plate 32 and into sleeve 10. Bolt 7 when inserted pushes firmly against rod 17 thereby causing it to slightly move further away from opening 4 (see FIG. 7*b*). As rod 17 is moved back, it in turn causes bushing 18 to also move along its longitudinal axis in a direction away from opening 4. As bushing 18 is thus moved, roller 25*b* (see FIG. 4) slips off of bushing 18 thereby actuating switch mechanism 24.

Upon actuation of switch mechanism 24, a timing circuit is energized. The timing circuit forces sleeve 10 to pull away from inner wall 34 of plate 32. As sleeve 10 is retracted, the threads of bolt 7 are exposed to the coating material within chamber 3. The sleeve is only retracted by a predetermined distance which is adjusted by control knob 31 (as described above). The pressurized coating material is forced around the exposed threads of bolt 7 while bolt 7 is supported by plate 32 and sleeve 10 (see FIG. 7*c*).

Figure 7B:
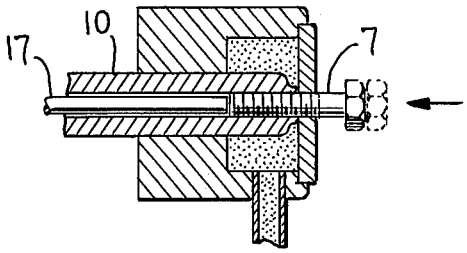
Figure 7C:
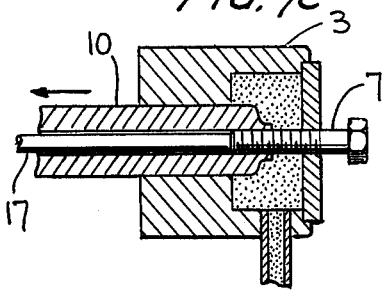
Figure 7D:
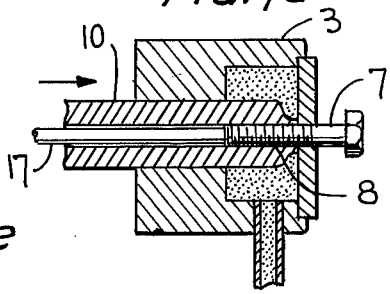
Figure 7E:
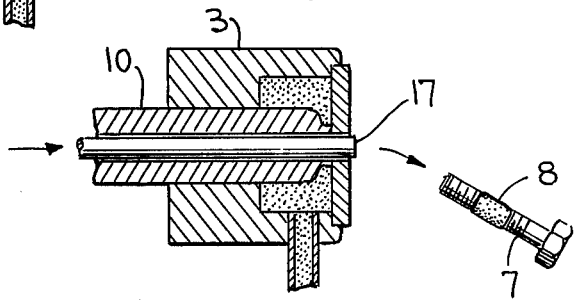

After a set time period, as determined by a timing circuit, sleeve 10 is allowed to return to its initial position. For this purpose, the air within pneumatic cylinder 15*a* is exhausted through port 16*a*. Air pressure is then applied through port 16*b* against face 15*d* of plate 15*c*. This pressure on face 15*d* along with spring 13 cause sleeve 10 to return to its initial position. The inner dimensions of sleeve 10 are appropriately dimensioned so that they are only very slightly larger than the outer dimensions of bolt 7. Consequently as sleeve 10 advances forward towards inner wall 34 of plate 32 the coating material is forced down into the threads of the bolt, the surface of the coated threads are smoothed and the excess slurry is displaced back into the chamber. During this operation, the contoured nature of surface 11 of sleeve 10 helps to allow the excess slurry to move away from the bolt back into the chamber. Bolt 7 with a layer of coating 8 is illustrated in FIG. 7*d* after sleeve 10 has been returned to its initial position.

Subsequent to the coating of bolt 7, rod 17 is advanced towards opening 4 thereby causing the ejection of bolt 7 from chamber 3. Ejection is accomplished through the extension of piston shaft 20*b* from cylinder 20*a* by pneumatic ejection mechanism 19. As the coated bolt is ejected, wall 33 of opening 4 helps to wipe off any excess coating material and to smooth out the layer of coating material on the bolt. After the bolt is ejected, rod 17 returns to its retracted position ready to begin another cycle.

A further explanation of the operation of the ejection mechanism will now be provided with reference to FIGS. 8 through 10. In its initial position, the lateral end surface of rod 17 positioned within bore 18*a* is separated by a free space 18*c* from the lateral end surface of piston shaft 20*b*. In this position, pin 29 is located at the end of slot 28 closest to cylinder 20*a*. When bolt 7 is inserted into the chamber, thereby pushing back rod 17 as shown in FIG. 7*b*, bushing 18 rides along pin 29 towards cylinder 20*a* into the position illustrated in FIG. 9. After coating of bolt 7 has been completed, as shown in FIG. 7*d*, shaft 20*b* is extended from cylinder 20*a*. Extension of shaft 20*b* is caused by the supply of air through inlet 21*a*. This causes pin 29 to push against the end of slot 28 closest to rod 17 thereby pushing bushing 18 and rod 17 towards opening 4, as illustrated in FIG. 10. As rod 17 moves toward opening 4, bolt 7 is ejected from coating chamber 3.

When bushing 18 reaches a predetermined forward position, it contacts roller 27*b* of limiting switch 26. This in turn causes ejection mechanism 19 to stop the forward motion of piston shaft 20*b* thereby ending the forward movement of rod 17. Limiting switch 26 also causes ejection mechanism 19 to cause piston shaft 20*b* to return to its initial position. For this purpose, the air within cylinder 20*a* is exhausted through outlet valve 21*b* thereby causing piston shaft 20*b* to retract back into cylinder 20*a*.

During such retraction, pin 29 is in the position within slot 28 as shown in FIG. 8. During this retraction, bushing 18 comes into friction contact with block 22. Block 22 is mounted so as to be pivotable about rod 38. End 22*a* of block 22 is spring biased by a spring 23 in an upward direction. Thus, as bushing 18 comes into contact with block 22, the block is pushed against the bushing thereby slowing down its movement and preventing any bounce in the movement of bushing 18 and rod 17 as they are retracted back to their initial position as shown in FIG. 8.

The coating applicator is controlled by an air logic control mechanism contained within control system 2, as shown in FIG. 1. The operation of this control system will be explained below with reference to the circuit diagram illustrated in FIG. 11 and pulse diagram illustrated in FIG. 12.

When selector switch 39 on the control panel is set into its operate mode, the reservoir supply valve 44 is closed so as to fill interior 9 of chamber 3 with coating material. The indicating valve 43 indicating that the machine is on and operating is also closed. The sleeve exhaust and sleeve retract valves (47 and 46) are maintained in their normal positions. Likewise, the eject extend valve and the exhaust valve (48 and 49) are also maintained in their normal positions. Valves 46, 47 and 48, 49 can be utilized for manually retracting the sleeve cylinder and extending the eject cylinder, respectively, when setting up and cleaning out the system. At all other times, these valves remain in their normal positions as shown in FIG. 11.

Finally, operate valve 45 is switched into a closed position so as to allow for initiation of operation. Upon selection of the operate mode, sleeve 10 is maintained in the extended position through signals from flip-flop ($F\text{-}F_1$) 54, at ports *b-e* and *d* and the eject cylinder is maintained in a retract position through signals from flip-flop ($F\text{-}F_2$) 55 at ports *b-e* and *c*.

Upon insertion of bolt 7, actuator 51 supplies an air pulse through bulkhead 52 to differential amplifier 53. In turn, differential amplifier 53 provides a pulse signal to set port terminal *a* of flip-flop 54 and thereby actuating flip-flop 54.

Upon actuation of flip-flop 54, the output at port *d* is switched off and the output at port *c* is switched on thereby providing a signal to both sleeve retract valve 46 and timer 56. Actuation of sleeve retract valve 46 causes bulkhead 57 to supply air to sleeve cylinder 15*a* through inlet 16*a*. This causes sleeve 10 to retract from its position against inner wall 34.

The air signal supplied to timer 56 is supplied to both input terminal *b* of the AND-gate and through a slow pressurized timing circuit $T_1$. After the delay caused by timing circuit $T_1$, a signal is supplied to second input terminal *a* of the AND-gate. In turn, an output is then supplied from the AND-gate at terminal *c*. This output, in turn, is sent back to flip-flop 54 through reset port *f*. The output at port *c* of flip-flop 54 is then switched off and the output at port *d* is switched back on thereby providing a signal through sleeve exhaust valve 47 and hence bulkhead 61 so as to cause sleeve 10 to return to its extended position. The output at port *d* of flip-flop 54 also provides an input signal at port *a* of timer 58.

Timer 58 operates in the same manner as timer 56 and after a set time delay period, an output is provided to differential amplifier 59. The differential amplifier converts the signal from the timer into a pulse to be supplied to set port *f* of flip-flop 55. In turn, the output at port *c* of flip-flop 55 is switched off and the output at port *d* switches back on thereby providing a signal through eject extend valve 48 and hence bulkhead 60 so as to supply air through input line 21*a* so as to cause piston shaft 20*b* to extend from cylinder 20*a*. Extension of piston shaft 20*b* in turn causes rod 17 to knock the coated bolt out of the coating chamber.

When piston shaft 20*b* has been extended to its full stroke, limit valve 63 is actuated so as to supply an air pulse through bulkhead 64. This signal in turn is transmitted to reset port *a* of flip-flop 55. The output at port *d* of flip-flop 55 is then switched off and the output at port *c* is switched back on thereby ending the cycle.

During the above described operations, pressurized air within the air cylinders (sleeve and eject) is exhausted through an exhaust port contained in flip-flops $F\text{-}F_1$ and $F\text{-}F_2$. This pressurized air is allowed to exhaust when the flip-flop is either set or reset or accordingly when the output ports *c* or *d* are turned off.

In FIG. 12, a time pulse diagram is presented illustrating the pulses for controlling the sleeve retraction mechanism and the ejection mechanism. Additionally, in this Figure, the relative time periods of operation are also illustrated.

It should be noted with respect to the above air logic diagram illustrated in FIG. 11 that these operations could also be controlled by an electrical circuit diagram. The utilization of air logic has been selected as a preferred embodiment, however, since in the preferred embodiment the moving parts are controlled by pneumatic control mechanisms and hence the air supply is already present within the system.

It is noted that the above description and the accompanying drawings are provided merely to present exemplary embodiments of the present invention and that additional modifications of such embodiments are possible within the scope of this invention without deviating from the spirit thereof.

We claim:

1. A coating apparatus for applying a layer of coating material around the circumference of a portion of an elongated member, the coating apparatus comprising:

a chamber capable of being filled with coating material, said chamber having an opening for receiving an elongated member to be coated, said opening having dimensions slightly larger than the cross-sectional dimensions of such elongated member;

means to fill said chamber with coating material;

a retractable cover member arranged within said chamber for preventing coating material from leaking out of said chamber through said opening;

means for retracting said cover member after an elongated member to be coated has been inserted through said opening into said chamber to the full extent necessary for coating such elongated member, said cover member being retracted so as to allow coating material to totally surround the entire circumference of a limited longitudinal portion of such elongated member, thereby causing such portion to be coated with coating material; whereby after coating of the elongated member, when the elongated member is removed from said chamber the inner walls of said chamber defining said opening serve to remove excess coating material from the elongated member and to smooth the coated material on the elongated member.

2. Coating apparatus as defined in claim 1, further comprising: means for automatically ejecting the elongated member from said chamber after coating; and wherein said means for retracting said cover member includes means for returning said cover member to its initial position in conjunction with said ejection means ejecting the elongated member.

3. A coating apparatus as defined in claim 2 wherein said cover member is a sleeve having inner dimensions sufficiently large to surround the perimeter of said opening, said sleeve has its lateral end surface shaped so as to correspondingly mate with the inner surface of said chamber surrounding said opening, and said sleeve being sufficiently long so as to prevent coating material from contacting an inserted elongated member until said sleeve has been retracted by said retracting means.

4. A coating apparatus as defined in claim 3 wherein said opening extends in a direction parallel to the longitudinal axis of said chamber and said sleeve has its longitudinal axis extending in a direction parallel to the longitudinal axis of said chamber and is retractable along such longitudinal axis by said retracting means.

5. A coating apparatus as defined in claim 4 wherein the distance by which said sleeve is retracted by said retracting means is adjustable so as to make it possible to vary the portion of the elongated member contacted by coating material.

6. A coating apparatus as defined in claim 4 wherein said retracting means further includes means for normally biasing said sleeve into contact with the inner surface of said chamber surrounding said opening.

7. A coating apparatus as defined in claim 4 wherein said ejection means includes a movable rod located within said sleeve and means for moving said rod in a direction towards said opening so as to eject an elongated member from said chamber.

8. A coating apparatus as defined in claim 7 further comprising control means including:

actuating means for sensing the insertion of an elongated member through said opening into said chamber in a coating position and for actuating said means for retracting said sleeve in response to the sensing of an inserted elongated member for causing said sleeve retracted;

timing means for determining a coating period and for causing said retracting means to enable said sleeve to return to its initial position at the end of such coating period; and, means for actuating said ejection means after said sleeve has been returned to its initial position for ejecting a coated elongated member.

9. A coating apparatus as defined in claim 8 wherein said sleeve has inner dimensions slightly larger than the dimensions of the elongated member to be coated so that as said sleeve is returned to its initial position excess coating material is removed from the coated portion of the elongated member.

10. A coating apparatus as defined in claim 9 wherein said sleeve has its end adjacent said opening contoured so that the outer wall of said end is of a smaller diameter than the diameter of the remaining portion of said sleeve so that there is a relatively small area of contact between said sleeve and said inner wall of said chamber thereby providing a better sealing contact between said sleeve and said inner wall for preventing leakage of coating material, said smaller diameter end portion allows coating material to flow away from said opening.

11. A coating apparatus as defined in claim 8 wherein:

said ejection means includes a movable bushing and said rod, said bushing being mounted on said rod and said rod being initially located in the path of insertion of an elongated member so that when the elongated member is inserted, said rod and said bushing are pushed in a direction away from said opening; and, said means for actuating said retracting means includes a switch having a lever mounted for contact with said bushing so that upon movement of said bushing in a direction away from said opening, said lever is moved for switching said switch.

12. A coating apparatus as defined in claim 11 further comprising a limit switch; and wherein said ejection means causes said bushing and said rod to move towards said opening for ejecting an elongated member from said chamber and said bushing activates said limit switch when it reaches a predetermined position during such forward movement; and said limit switch upon being activated causes said ejection means to return said bushing and said rod to their initial positions.

13. A coating apparatus as defined in claim 12 further comprising vibration dampening means for substantially preventing bounce is said bushing and said rod as they are returned to their initial positions.

14. A coating apparatus as defined in claim 11, wherein said ejection means includes a pneumatic cylinder having a chamber and a piston shaft mounted for movement within said chamber; said bushing has one end connected to said rod and its other end movably mounted on said piston shaft and said bushing has a longitudinally extending slot, said piston shaft has a pin arranged so as to be movable within said slot provided in said bushing; said rod and said piston shaft being separated so as to provide for a free space along which said bushing and said rod can be moved towards said piston shaft upon insertion of an elongated member into said chamber; whereby said pin is initially located at an end of said slot closest to said pneumatic cylinder, as said rod and said bushing are pushed away from said opening, said pin comes into contact with the opposite end of said slot and said ejection means causes said pneumatic cylinder to extend said piston shaft and thus said bushing and said rod in a direction for ejecting the coated elongated member.

15. A coating apparatus as defined in claim 14 wherein the initial positions of said rod, said bushing and said piston shaft are adjustble so as to enable said chamber to accommodate elongated members of varying lengths.

16. A coating apparatus as defined in claim 14, wherein said ejection means returns said bushing and said rod to their initial positions after ejection of the coated elongated member and further comprising means for substantially preventing bounce in the movement of said bushing and said rod as they are returned to their initial positions.

17. A coating apparatus for applying a layer of coating material in a continuous path around the entire circumference of an external portion of an elongated member, the coating apparatus comprising:

a chamber having an opening for receiving an elongated member;

means for filling the chamber with coating material;

means for sensing the insertion of an elongated member through said opening into said chamber;

means for preventing coating from leaking through said opening within said chamber and also from contacting the elongated member until such member has been fully inserted through said opening;

means for allowing coating material to contact the entire circumference of a limited longitudinal portion of the inserted elongated member; and, means for ejecting the elongated member after having been coated.

18. A coating apparatus as defined in claim 17 wherein said opening in said chamber is appropriately dimensioned so as to be only slightly larger than the cross-sectional dimensions of the elongated member to be coated whereby after the elongated member is coated and as it is ejected from said chamber, the inner walls of said chamber defining said opening serve to remove excess coating material from the elongated member and to smooth the coated material on the elongated member.

19. A coating apparatus as defined in claim 17 wherein said ejecting means includes a movable rod located within said chamber and means for moving said rod in a direction towards said opening so as to eject the elongated member from said chamber.

20. A coating apparatus as defined in claim 17 further comprising timing means for determining a coating period and for actuating said ejecting means at the end of such coating period.

21. A coating apparatus as defined in claim 20 wherein said means for allowing coating material to contact an elongated member also deactivates said means for preventing the leakage of coating material towards said opening and said timing means provides a signal for the controlling the reactivation of said means for preventing leakage at the end of the coating period.

* * * * *